US006431877B1

(12) United States Patent
Lemke et al.

(10) Patent No.: US 6,431,877 B1
(45) Date of Patent: Aug. 13, 2002

(54) ELECTRICAL CONNECTOR COMPRISING BASE WITH CENTER APERTURE

(75) Inventors: Timothy A. Lemke, Dillsburg; Timothy W. Houtz, Etters, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/541,128

(22) Filed: Mar. 31, 2000

(51) Int. Cl.[7] ..... H01R 12/14
(52) U.S. Cl. ..... 439/70; 439/75
(58) Field of Search ..... 439/70, 71, 74, 439/75, 525, 526

(56) References Cited

U.S. PATENT DOCUMENTS

| | | | | |
|---|---|---|---|---|
| 3,393,396 A | * | 7/1968 | Majewski | 439/525 |
| 5,078,610 A | * | 1/1992 | Matsuoka et al. | 439/70 |
| 5,310,350 A | * | 5/1994 | Matsuoka et al. | 439/72 |
| 5,702,256 A | * | 12/1997 | Severn | 439/71 |
| 5,781,759 A | * | 7/1998 | Kashiwabara | 439/70 X |

FOREIGN PATENT DOCUMENTS

| | | |
|---|---|---|
| DE | 298 02 548 | 4/1998 |
| EP | 0 863 576 | 9/1998 |
| WO | WO 98/15989 | 4/1998 |

* cited by examiner

*Primary Examiner*—Renee Luebke
(74) *Attorney, Agent, or Firm*—Woodcock Washburn LLP

(57) ABSTRACT

An electrical connector has a non-conductive planar base defining a centrally located center aperture extending therethrough. The base has at least three generally identical sectors circumferentially arranged around the center aperture. Each sector defines a plurality of contact-receiving apertures extending through the base in a first direction perpendicular to the base. The contact-receiving apertures in each sector are organized into a plurality of rows. Each row in each sector extends along the base in a second direction with regard to such center aperture. The base is formed from an injection mold that includes a gate structure at the center aperture of the to-be-molded base. A non-conductive molding material is injected into the injection mold through the gate structure, whereby the injected material is generally evenly distributed into each sector of the base. The contacts are inserted into each contact-receiving aperture by mounting the base to a platform rotatable on an axis such that the base is perpendicular to the axis and such that the axis is coincident with the center aperture. The platform and the base mounted thereto are rotated to a first position wherein the field of view of a contact insertion device positioned adjacent the platform coincides with a first one of the sectors of the base, and the contact insertion device inserts a contact into each contact-receiving aperture of the first one of the sectors. Rotation and insertion are repeated for each additional sector.

9 Claims, 6 Drawing Sheets

ELECTRICAL CONNECTOR COMPRISING BASE WITH CENTER APERTURE

FIELD OF THE INVENTION

The present invention relates to an electrical connector for use in connection with an electrical package having a relatively large number of terminals. More particularly, the present invention relates to such an electrical connector having a center aperture and a plurality of generally identical sectors surrounding the center aperture, each sector having a plurality of contacts for being brought into electrical contact with the terminals of the electrical package.

BACKGROUND OF THE INVENTION

Typically, a microprocessor, controller, or other micro-electronic device is mounted or housed within an electrical package. In one typical scenario, such electrical package also includes terminals for coupling such package to a first corresponding electrical connector, where the first electrical connector mounts to a second corresponding electrical connector on a substrate. In other typical scenarios, either the first or the second electrical connector are dispensed with, and the package with the first connector mounts directly to the substrate or the package mounts directly to the second connector on the substrate. In any case, at least one electrical connector is present, and the electrical connector includes contacts corresponding to the terminals of the electrical package. As may often be the case, the microprocessor, controller, or other micro-electronic device within the package requires a relatively high number of connections to the outside world, and therefore a relatively high number of terminals are positioned on the package and a corresponding number of contacts are positioned on the at least one electrical connector.

Conventionally, an electrical connector with a relatively high number of contacts typically has such contacts arranged into a plurality of rows in a high density arrangement (0.050 inch center-spacing or smaller), where all of the rows extend in the same general direction. However, when all of the rows extend in the same general direction, and if the planar extent of the electrical connector is sufficiently large, machinery employed to insert contacts into the connector during production thereof may find it difficult to reach every location where a contact is to be inserted, particularly toward the center of the connector. Accordingly, a need exists for an electrical connector having a design that alleviates such production issues.

In the aforementioned prior art electrical connector, all of the rows typically substantially fill the planar extent of the electrical connector. However, when all of the rows substantially fill the planar extent of the electrical connector, and if sufficient thermal activity takes place during operation of the package, such thermal activity can exert un-relieved thermal stresses on the connector. As may be appreciated, such un-relieved thermal stresses can warp or even crack the connector, and repeated cycles of such un-relieved thermal stresses can act to move contacts out of electrical connection with corresponding contacts and/or terminals. Accordingly, a need exists for an electrical connector having a design that better accommodates such thermal stresses.

The aforementioned prior art electrical connector is typically constructed from a non-conductive material during an injection molding process, where the material is gated into the injection mold at at least one location. As is to be appreciated, such molding material must expand into the mold past many mold features (contact-receiving aperture definitions in the mold, in large part) and completely fill the mold to faithfully render the connector within the mold. However, the many mold features and the relatively large distances that must be traversed by the molding material raise the likelihood that unwanted voids will be formed, and/or that the molding material will solidify prior to completely filling the mold. In such a situation, the formed connector must be discarded as a failure. Accordingly, a need exists for an electrical connector having a design that is more amenable to the injection molding process.

SUMMARY OF THE INVENTION

The present invention satisfies the aforementioned need by providing an electrical connector comprising a non-conductive generally planar base defining a generally centrally located center aperture extending therethrough. The base has at least three generally identical sectors, where the sectors are circumferentially arranged around the center aperture. Each sector defines a plurality of contact-receiving apertures extending through the base in a first direction generally perpendicular to the base, where each contact-receiving aperture is for receiving a contact. The contact-receiving apertures in each sector are organized into a plurality of rows. Each row in each sector extends along the base in a second direction with regard to such center aperture.

The base is formed by providing an injection mold defining the base, where the injection mold includes a gate structure at the center aperture of the to-be-molded base. A non-conductive molding material is injected into the injection mold through the gate structure at the center aperture of the to-be-molded base, whereby the injected material is generally evenly distributed into each sector of the base. The molded base is then removed from the injection mold.

The contacts are inserted into each contact-receiving aperture by mounting the base to a platform rotatable on an axis such that the base is generally perpendicular to the axis and such that the axis is coincident with the center aperture. A contact insertion device is positioned adjacent the platform and has a field of view comprising a circumferential portion of the platform. The platform and the base mounted thereto are rotated to a first position wherein the field of view of the contact insertion device coincides with a first one of the sectors of the base, and the contact insertion device inserts a contact into each contact-receiving aperture of the first one of the sectors. Rotation and insertion are repeated for each additional sector.

BRIEF DESCRIPTION OF THE DRAWINGS

The foregoing summary as well as the following detailed description of the present invention will be better understood when read in conjunction with the appended drawings. For the purpose of the illustrating the invention, there are shown in the drawings embodiments which are presently preferred. As should be understood, however, the invention is not limited to the precise arrangements and instrumentalities shown. In the drawings.

DETAILED DESCRIPTION OF PREFERRED EMBODIMENTS

Figure 1:
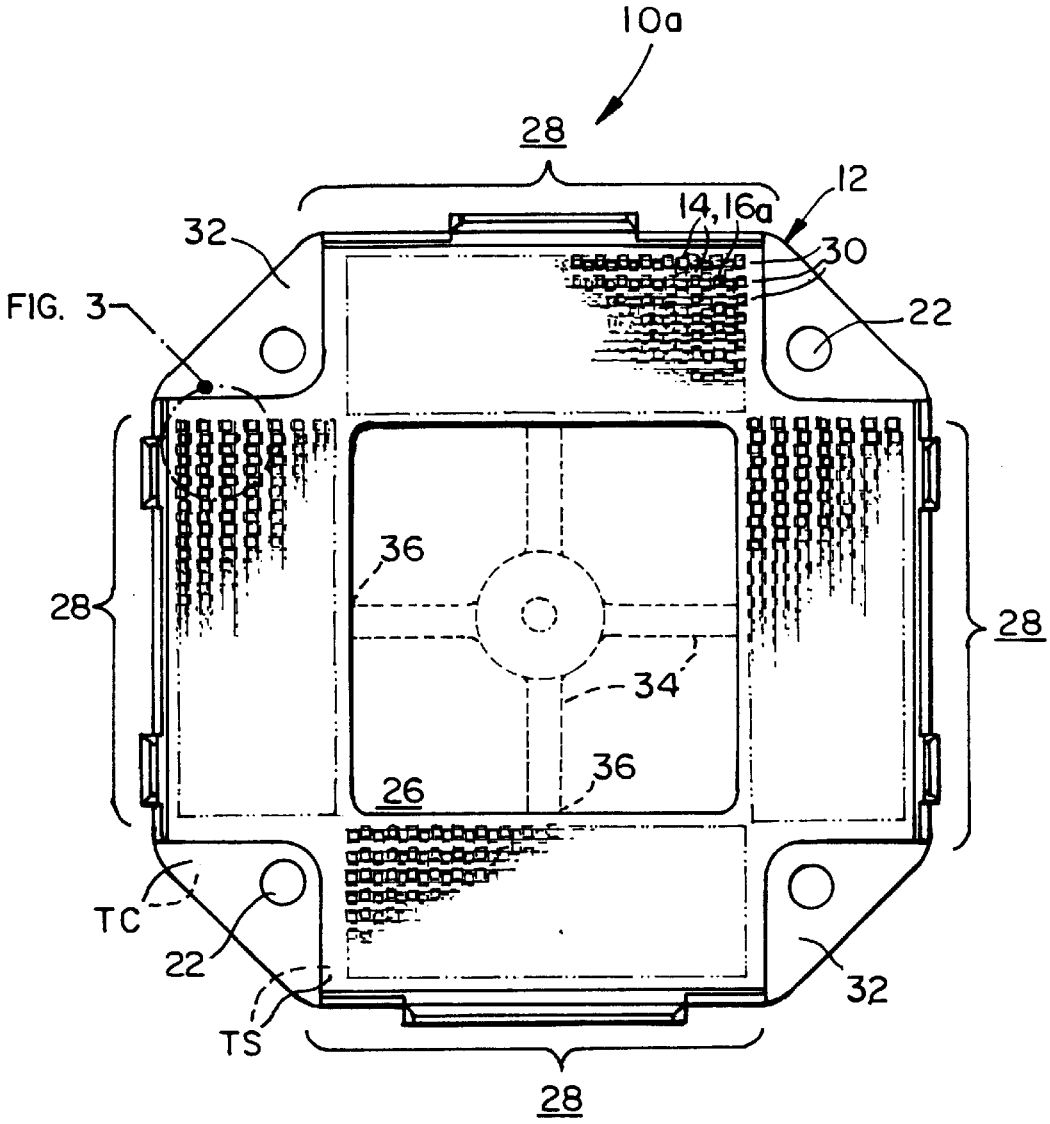
FIG. 1 is a plan view of an electrical connector in accordance with one embodiment of the present invention.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIGS. 1–6 mating connectors 10*a,* 10*b* constructed in accordance with one embodiment of the present invention. As seen, each mating connector 10*a,* 10*b* comprises a generally planar base 12 defining a plurality of contact-receiving apertures 14. Each contact-receiving aperture 14 receives an appropriate contact 16*a,* 16*b*. The apertures 14 and contacts 16*a,* 16*b* in the connectors 10*a,* 10*b* are arranged in a complementary manner such that each contact 16*a* in the connector 10*a* electrically couples to a corresponding contact 16*b* in the connector 10*b* when the mating connectors 10*a,* 10*b* are coupled.

Figure 2:
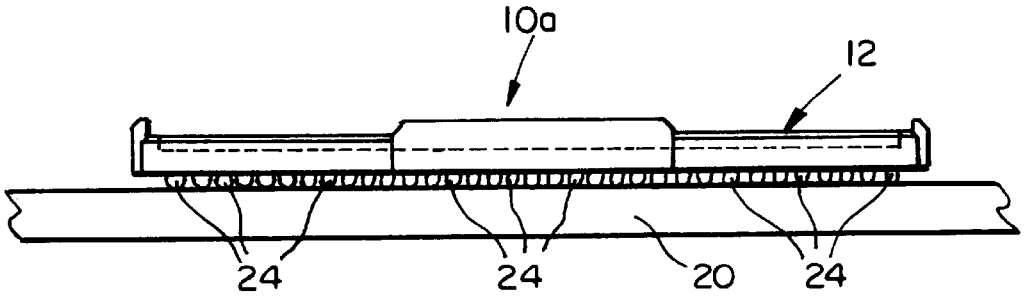
FIG. 2 is a side view of the electrical connector of FIG. 1 as coupled to a substrate in accordance with one embodiment of the present invention.
Figure 3:
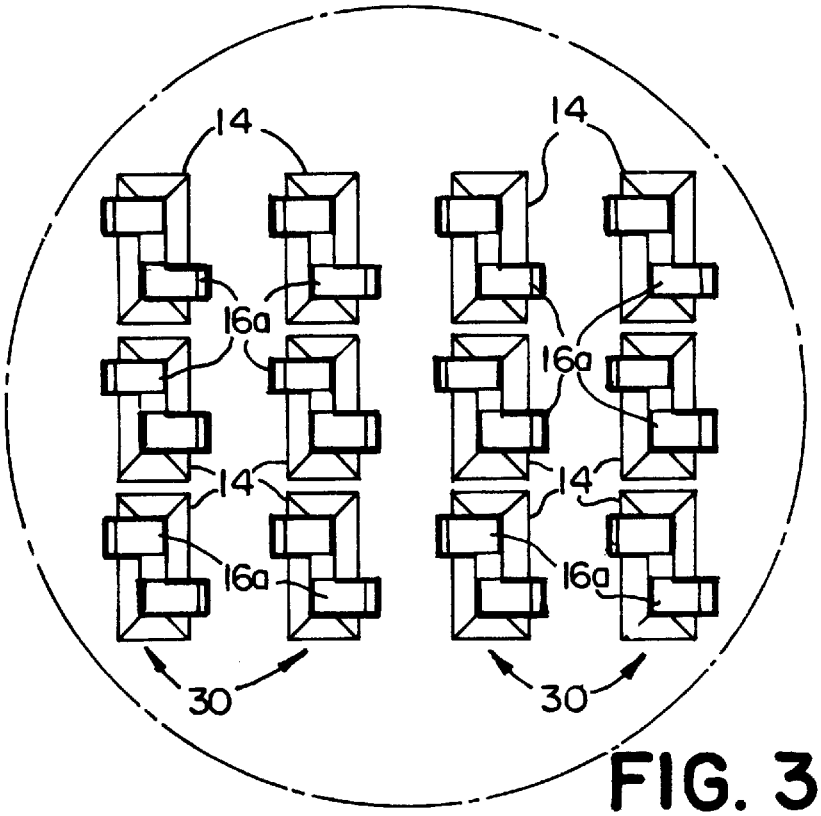
FIG. 3 is an enlarged view of a portion of FIG. 1, and shows the contacts employed in the electrical connector of FIG. 1.
Figure 6:
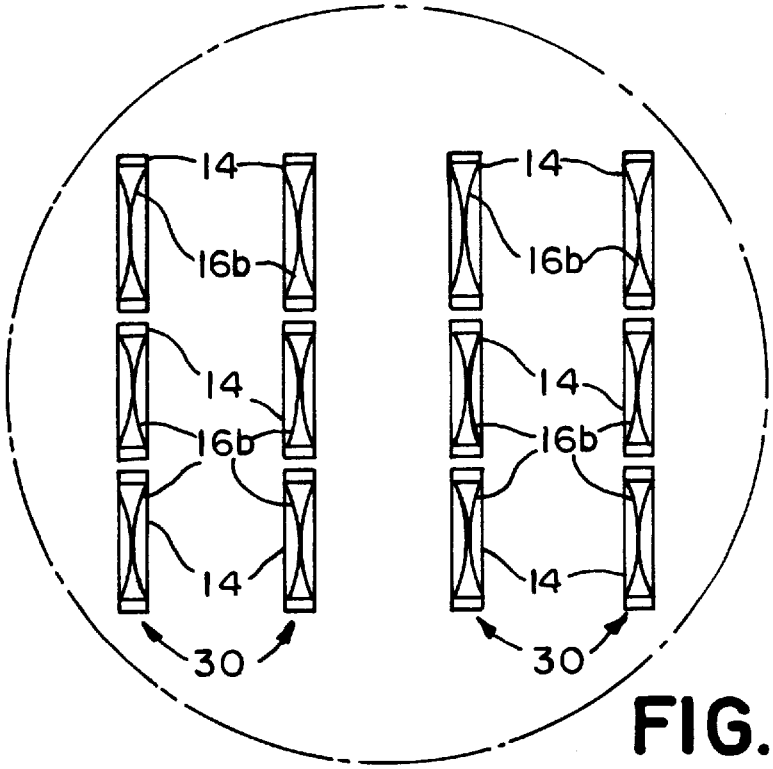
FIG. 6 is an enlarged view of a portion of FIG. 4, and shows the contacts employed in the electrical connector of FIG. 4.
Figure 5:
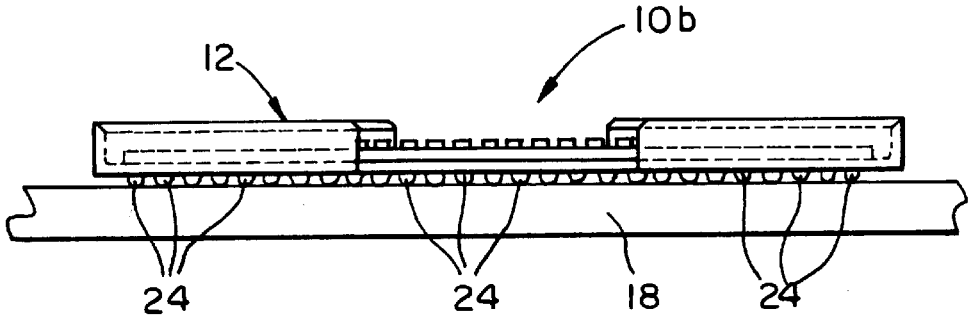
FIG. 5 is a side view of the electrical connector of FIG. 4 as coupled to a package in accordance with one embodiment of the present invention.

In one embodiment of the present invention, one mating connector 10*a,* 10*b* is electrically secured to terminals of an electrical package 18 (FIG. 5 shows connector 10*b* so coupled) while the other mating connector 10*a,* 10*b* is electrically secured to a substrate 20 (FIG. 2 shows connector 10*a* so coupled) such as a printed circuit board such that the package 18 is mounted to the substrate 20 by way of both mating connectors 10*a,* 10*b*. Each of the connectors 10*a,* 10*b* may include various keying features to ensure alignment of the contacts 16*a,* 16*b* during mounting. In addition, the connectors 10*a,* 10*b* may include screw apertures 22 for receiving jack screws (not shown) to further ensure alignment. Such jack screws when tightened also provide motive force for securely coupling each pair of corresponding contacts 16*a,* 16*b* in the connectors 10*a,* 10*b*.

In one alternative embodiment of the present invention, the contacts 16*a,* 16*b* of one mating connector 10*a,* 10*b* are integrally coupled to the terminals of the package 18 and employed to mount such package 18 directly to the other mating connector 10*a,* 10*b* on the substrate 20. In another alternative embodiment, the contacts 16*a,* 16*b* of one mating connector 10*a,* 10*b* are integrally coupled to the substrate 20 and employed to receive the other mating connector 10*a,* 10*b* as electrically secured to the package 18. Any appropriate method of electrically securing the contacts 16*a,* 16*b* of the connector 10*a,* 10*b* to the package 18 or the substrate 20 may be employed without departing from the spirit and scope of the present invention. For example, the contacts 16*a,* 16*b* may be provided with fusible elements such as solder balls 24 or the like and solder-coupled to respective terminals on the package 18 or substrate 20.

Each contact 16*a,* 16*b* is constructed as a generally unitary body from a conductive material such as KOVAR (a low coefficient of thermal expansion (CTE) material). However, each contact 16*a,* 16*b* could be formed from any suitable conductive material including a copper material, a brass material, a stainless steel material, a gold material, a metal alloy material, or the like. However, each contact 16*a,* 16*b* may be formed from any other conductive material without departing from the spirit and scope of the present invention. Moreover, the contacts 16*a,* 16*b* may be any appropriate contacts 16*a,* 16*b* without departing from the spirit and scope of the present invention. For example, and as seen in FIGS. 2 and 5, the connector 10*a* may have dual-beam-type contacts 16*a* and the connector 10*b* may have complementary blade-type contacts 16*b,* where one beam of each contact 16*a* is in physical contact with each side of the blade of each corresponding contact 16*b* when the contacts 16*a,* 16*b* are appropriately mated. An example of such contacts 16*a,* 16*b* is disclosed in International Publication No. WO 98/15989 (based on International Application No. PCT/US97/18066), hereby incorporated by reference. As may be appreciated, by using dual-beam contacts 16*a* and blade contacts 16*b,* as shown, contact spacing (center to center) may be about 0.05 inches or less, with a resulting relatively high contact density on the connectors 10*a,* 10*b*.

Figure 8:
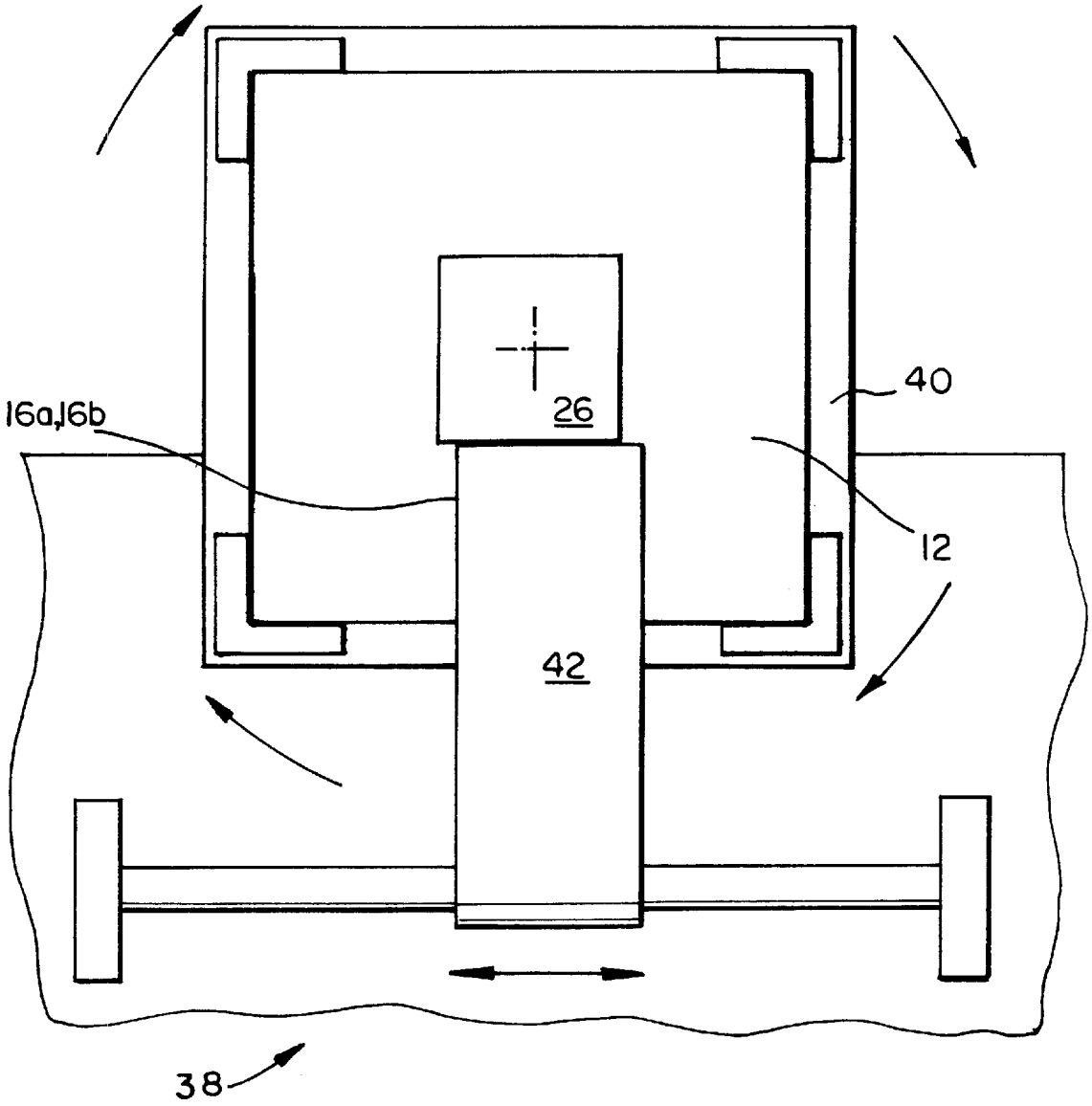
FIG. 8 is a top plan view of an apparatus employed to load contacts into the base of a connector such as the connectors of FIGS. 1–6 in accordance with one embodiment of the present invention.

The contact-receiving apertures 14 are sized to securely receive the contacts 16*a,* 16*b*. As may be appreciated, such apertures 14 extend between both planar sides of the bases 12 of the connectors 10*a,* 10*b* since the contacts 16*a,* 16*b* received therein must be accessible at both planar sides of the base 12. In one embodiment of the present invention, the apertures 14 are organized into rows such that a contact-insertion device (FIG. 8) inserting contacts 16*a,* 16*b* therein inserts such contacts 16*a,* 16*b* row-by-row. Any appropriate aperture 14 may be employed without departing from the spirit and scope of the present invention, as long as the aperture 14 is designed to and does in fact securely hold a received contact 16*a,* 16*b* therein. In addition, any appropriate contact-insertion device and method may be employed without departing from the spirit and scope of the present invention.

In one embodiment of the present invention, and still referring to FIGS. 1–6, the base 12 of the connector 10*a,* 10*b* defines a generally centrally located center aperture 26 extending therethrough. As should be appreciated, the center aperture 26 is much larger than any of the contact-receiving apertures 14, and in fact is not expected to receive any element, although an element may still be received therein without departing from the spirit and scope of the present invention. Preferably, the base 12 has at least three generally identical sectors 28, where each sector 28 is circumferentially arranged around the center aperture 26. In FIGS. 1–6, the base 12 of the connector 10*a,* 10*b* is generally a square and has four such generally identical sectors 28, where each sector 28 roughly corresponds to a side of the square. However, the base 12 may alternatively have three, five, six, seven, eight, etc. such sectors 28 without departing from the spirit and scope of the present invention. In any event, the sectors 28 generally surround and at least partially define the center aperture 26, and thus extend generally tangentially with regard to such center aperture 26, as shown.

Each sector 28 defines a plurality of contact-receiving apertures 14, as shown. As is to be expected, each contact-receiving aperture 14 in each sector 28 extends through the base 12 in a first direction generally perpendicular to such base 12. Thus, and as was discussed above, each contact-receiving aperture 14 can receive a contact 16*a,* 16*b* therein such that the received contact 16*a,* 16*b* is accessible from both planar sides of the base 12.

Figure 4:
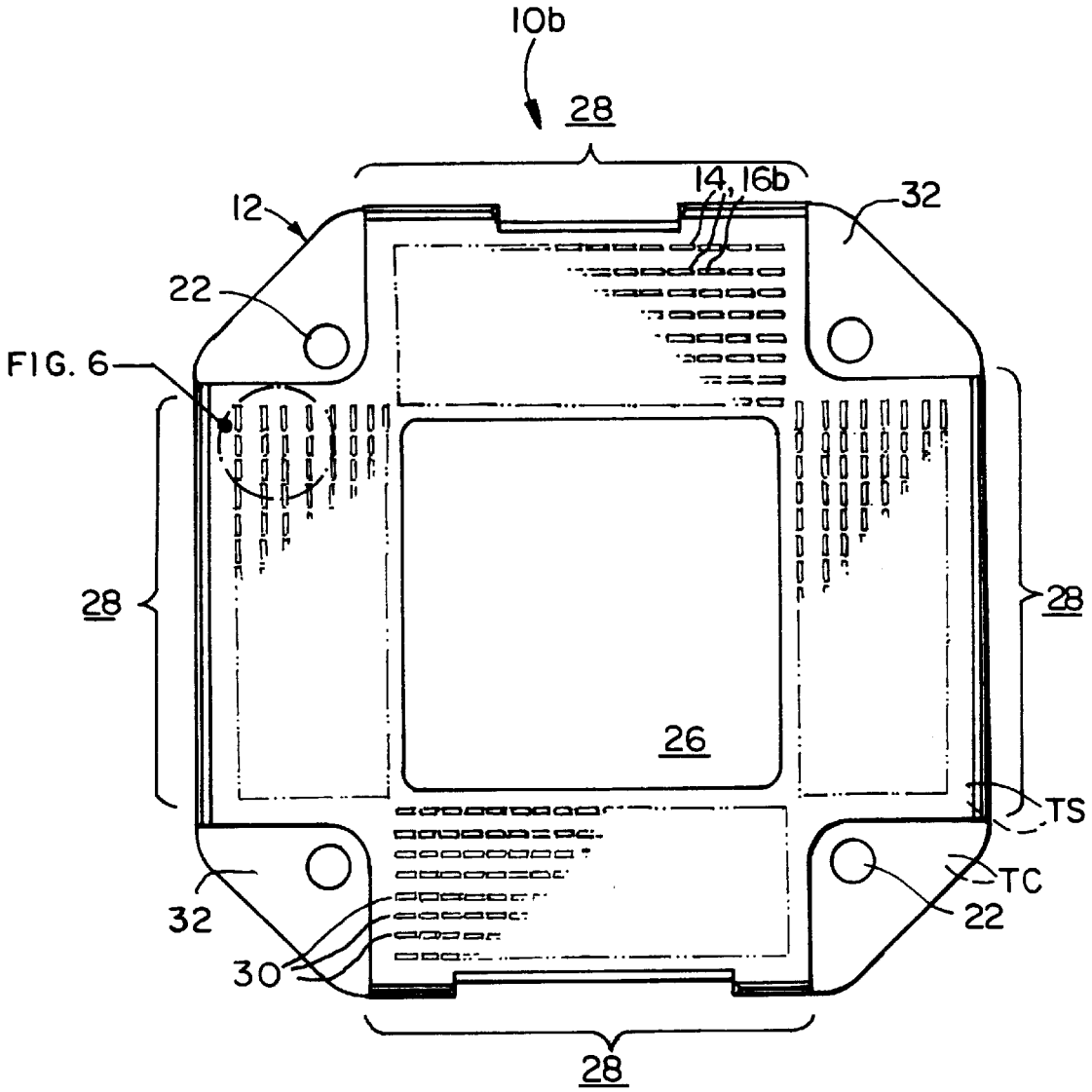
FIG. 4 is a plan view of an electrical connector suitable for mating with the electrical connector of FIG. 1 in accordance with one embodiment of the present invention.

Importantly, the contact-receiving apertures 14 in each sector 28 are organized into a plurality of rows 30, and each row 30 in each sector 28 extends along the base 12 in a second direction with regard to center aperture 26. That is, although rows 30 from different sectors 28 may not extend in the same direction, within a sector all of the rows extend in the same (second) direction. Nevertheless, such second direction is always the same with regard to the center aperture 26, even across different sectors 28. In one embodiment of the present invention, and as shown in FIGS. 1 and 4 in particular, the second direction is generally tangential with regard to the center aperture 26, where the rows 30 are generally linear and parallel with each other. That is, the rows 30 are generally parallel to the adjacent edge of the base 12. Of course, the second direction may have a different orientation with regard to the center aperture 26 without regard to the spirit and scope of the present invention. For example, the second direction may be generally radial with regard to the center aperture 26, where the rows 30 are generally parallel with each other and are perpendicular to the adjacent edge of the base 12.

In one embodiment of the present invention, the contacts 16*a,* 16*b* are generally planar in the region where such contacts 16*a,* 16*b* are secured within corresponding contact-receiving apertures 14. Accordingly, each such contact-receiving aperture 14 is generally narrow at least in the dimension spanning from one planar side to the other planar side of a received contact 16*a,* 16*b*. Correspondingly, the contacts 16*a,* 16*b* have an appreciable lateral extent in the region where such contacts 16*a,* 16*b* are secured within corresponding contact-receiving apertures 14. Accordingly, each such contact-receiving aperture 14 extends a distance in the dimension spanning from one lateral side to the other lateral side of a received contact 16*a,* 16*b,* i.e. in a third direction in the base 12 with regard to such center aperture 26. As should be appreciated, the third direction is generally parallel to the base 12. In fact, in the embodiment of the present invention shown in FIGS. 1–6, the third direction and the second direction may be generally identical. In such a situation, it will be appreciated that each contact-receiving aperture 14 in each sector 28 extends along the base 12 generally tangentially with regard to the center aperture 26. However, the third direction may differ with regard to the second direction without departing from the spirit and scope of the present invention. For example, the third direction may be generally perpendicular to the second direction.

As may be appreciated, the center aperture 26 of the connector 10*a,* 10*b* of the present invention allows such connector 10*a,* 10*b* to be able effectively accommodate and relieve mechanical and thermal stresses, among other things. That is, the center aperture imparts a relatively large degree of flexibility to the connector 10*a,* 10*b*. Accordingly, mechanical and thermal activity experienced by the connector 10*a,* 10*b* will be less likely to warp or crack the connector 10*a,* 10*b,* and it is likely, that repeated cycles of mechanical or thermal stresses will act to move contacts 16*a,* 16*b* out of electrical connection with corresponding contacts 16*a,* 16*b* and/or terminals.

In one embodiment of the present invention, in an effort to even more effectively accommodate and relieve mechanical and thermal stresses on the connector 10*a,* 10*b,* among other things, the base 12 of such connector 10*a,* 10*b* is further provided with flexible corners 32. More particularly, the base 12 has a plurality of such comers 32 such that each sector 28 meets an immediately adjacent sector 28 at one of the corners 32. The base 12 also has a pair of opposing generally planar sides, each comer 32 has a first general side-to-side thickness TC, and each sector 28 has a second general side-to-side thickness TS greater than the first thickness TC. In fact, the first thickness TC may be as thin as the manufacturing process allows, although other thicknesses are possible and are within the spirit and scope of the present invention. As should be evident, then, the comers 32 provide the base 12 with an additional degree of flexibility over and above that provided by the center aperture 26 to relieve physical and thermal stresses to the base 12 of the connector 10*a,* 10*b*. As seen, the corners 32 may define the screw apertures 22, although such screw apertures 22 may reside elsewhere without departing from the spirit and scope of the present invention.

Figure 7:
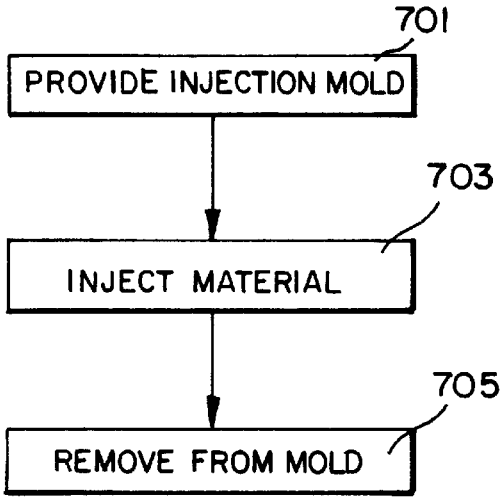
FIG. 7 is a flow chart detailing steps performed in forming the base of a connector such as the connectors of FIGS. 1–6 in accordance with one embodiment of the present invention.

The base 12 of the connector 10*a,* 10*b* may be formed in any appropriate manner from any appropriate non-conductive material without departing from the spirit and scope of the present invention. In one embodiment of the present invention, the base 12 is injection molded from a non-conductive material such as a ceramic material, a polymeric material such as a liquid crystal polymer, a thermosetting resin (e.g., FR4) or an elastomeric material. In particular, and as best seen in FIGS. 1 and 7, an injection mold is provided that defines the base 12, where the injection mold includes a gate structure 34 at the center aperture 26 of the to-be-molded base 12 (step 701). Of course, the injection mold is appropriately formed to include all necessary features of the base 12, including the sectors 28, the center aperture 26, the screw apertures 22, the corners 32, the contact-receiving apertures 14, etc.

As may be appreciated, the non-conductive material that is to form the base 12 is injected into the injection mold through the gate structure 34 at the center aperture 26 of the to-be-molded base 12 in a manner such that the injected material is generally evenly distributed into each sector 28 of the base 12 (step 703). In one embodiment of the present invention, and as seen, the gate structure 34 includes an egress 36 adjacent each sector 28 of the base 12 such that the injected material is generally evenly distributed from each egress 36 into the adjacent sector 28 of the base 12. Of course, multiple egresses 36 may also be employed for each sector 28, as may be alternate egress 36 and gate structure 34 designs, all without departing from the spirit and scope of the present invention.

Once properly injection molded by way of the injection mold and the gate structure 34 thereof, the molded base is removed from the injection mold (step 705). Of course, various finishing operations may be performed, such as for example, trimming of excess injected material and smoothing thereat. Overall, injection molds, injection molding, and finishing operations after injection molding are generally known to the relevant public. Accordingly, further details regarding same need not be provided herein.

As should now be appreciated, by centrally injection molding the base 12 of the connector 10*a,* 10*b* from the center aperture 26 of the to-be-molded base 12, the injected material evenly expands into the mold past the many mold features and thereby completely fills the mold to faithfully render the base 12 within the mold. Moreover, by such even expansion from multiple egresses 36 at a central location unwanted voids in the base 12 are minimized if not eliminated, and the injection material under proper conditions does not solidify prior to completely filling the mold.

Figure 9:
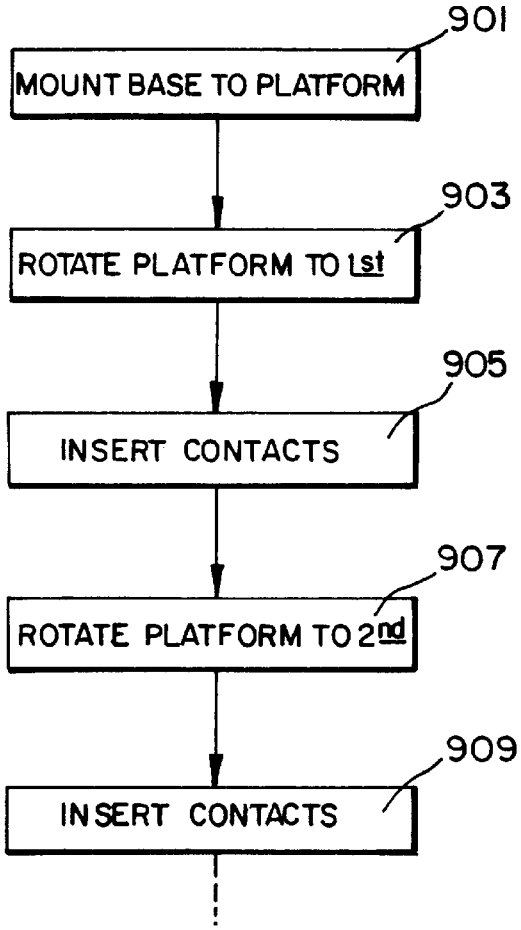
FIG. 9 is a flow chart detailing steps performed by the apparatus of FIG. 8 in accordance with one embodiment of the present invention.

Now that the base 12 has been formed, such base 12 must be loaded with the contacts 16*a,* 16*b*. In one embodiment of the present invention, and referring now to FIGS. 8 and 9, such contacts 16*a,* 16*b* are loaded by way of a loading apparatus 38 including a platform 40 rotatable on an axis and a contact insertion device 42 adjacent thereto. The finished base 12 sans the contacts 16*a,* 16*b* is appropriately mounted to the platform 40 such that the base 12 is generally perpendicular to the axis and the axis is coincident with the center aperture 26 (step 901). Importantly, the adjacent contact insertion device 42 is positioned over the base 12 on the platform such that the device 42 has a field of view comprising a circumferential portion of the platform 40. That is, the contact insertion device 42 upon being appropriately moved is capable of reaching any area within such circumferential portion.

As should now be appreciated, the rotatable platform 40 and the base 12 mounted thereto are rotated to a first position wherein the field of view of the contact insertion device 42 coincides with a first one of the sectors 28 of the base 12 (step 903). In such first position, the contact insertion device 42 inserts a contact 16*a,* 16*b* into each contact-receiving aperture 14 of the first one of the sectors 28 (step 905). The rotatable platform 40 and the base 12 mounted thereto are then rotated to a second position wherein the field of view of the contact insertion device 42 coincides with a second one of the sectors 28 of the base 12 (step 907). In such second position, the contact insertion device 42 inserts a contact 16*a,* 16*b* into each contact-receiving aperture 14 of the second one of the sectors 28. It should now be understood that the rotating and inserting steps are repeated until each sector 28 of the base 12 is filled with contacts 16*a,* 16*b*.

For the four-sector base 12 shown in FIGS. 1–6, the rotating and inserting steps are performed four times. Preferably, the rotation from position to position is about 90 degrees, although other angles of rotation may also be employed without departing from the spirit and scope of the present invention. Overall, loading apparati 38 for loading contacts 16*a,* 16*b* into a base 12 of a connector 10*a,* 10*b* and methods for using such loading apparati 38 are generally known to the relevant public. Accordingly, further details regarding same need not be provided herein.

As should now be appreciated, by employing a base 12 with a center aperture 26 and sectors 28 circumferentially surrounding such center aperture 26, and by filling the base 12 sector-by-sector, where the rows 30 of contacts 16*a,* 16*b* in each sector 28 are presented in the same manner to the contact insertion device 40, all of the contact receiving apertures are easily reachable by such contact insertion device 40, and such insertion may take place in an expeditious manner.

Figure 10:
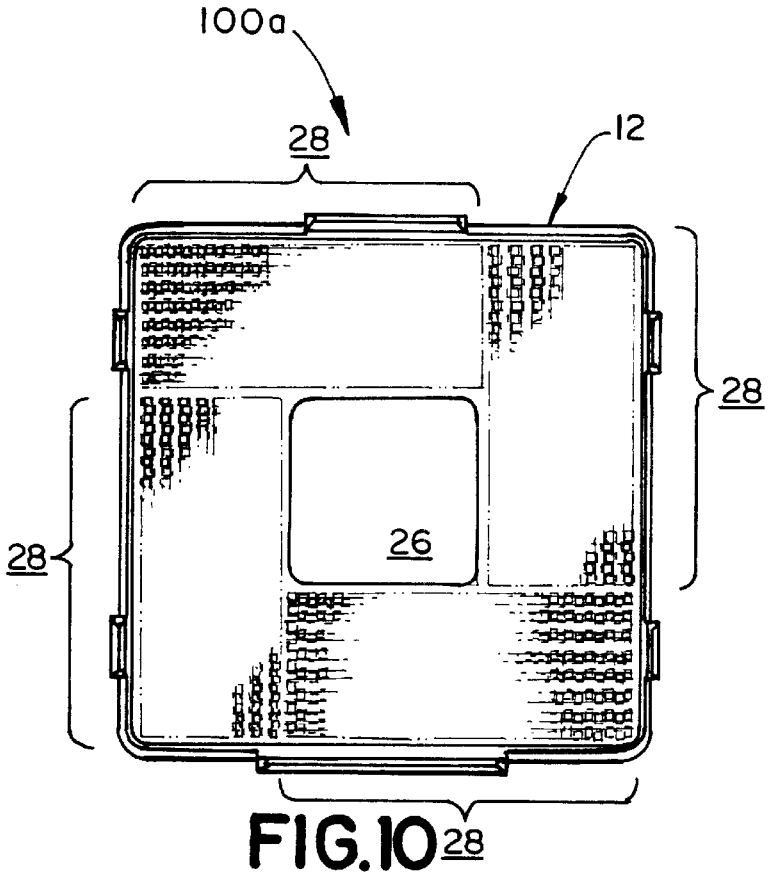
FIG. 10 is a plan view of an electrical connector in accordance with another embodiment of the present invention.
Figure 11:
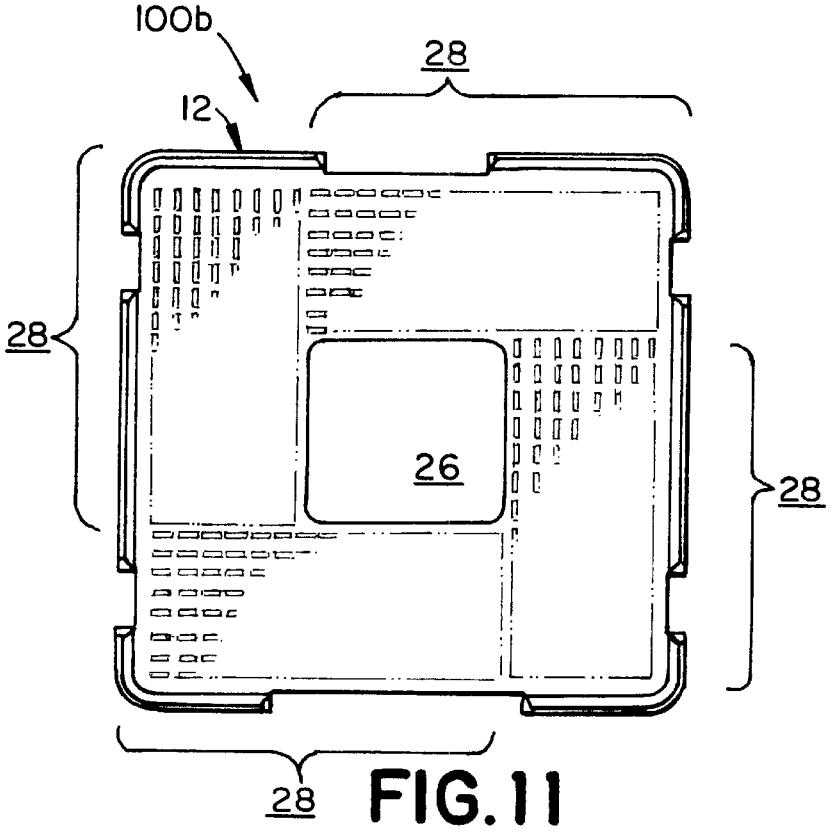
FIG. 11 is a plan view of an electrical connector suitable for mating with the electrical connector of FIG. 10 in accordance with the another embodiment of the present invention.

Referring now to FIGS. 10 and 11, a pair of connectors 100*a,* 100*b* are shown in accordance with another embodiment of the present invention. Such connectors 100*a,* 100*b* are similar to the connectors 10*a,* 10*b* of FIGS. 1–6 and therefore need not be described in detail. In pertinent part, the base 12 of the connector 100*a,* 100*b* defines a generally centrally located center aperture 26, and the base 12 has four generally identical sectors 28 circumferentially arranged around the center aperture 26. Each sector 28 in the connector 100*a,* 100*b* is organized into a plurality of rows 30, where each row 30 in each sector 28 extends generally tangentially with regard to such center aperture 26. Notably, though, each sector 28 and the rows 30 therein extends into an area reserved as a corner 32 in the connectors 10*a,* 10*b*. In addition, the base 12 of the connector 100*a,* 100*b* does not include screw apertures 22 for jack screws or the like.

The base 12 of the connector 100*a,* 100*b* may be formed in substantially the same manner as the base 12 of the connector 10*a,* 10*b,* i.e., by way of a centrally located gate structure 34 such as that shown in FIG. 1. Moreover, the contacts 16*a,* 16*b* may be loaded into the base 12 of the connector 100*a,* 100*b* in substantially the same manner as into the base 12 of the connector 10*a,* 10*b,* i.e., by way of the loading apparatus 38 of FIG. 8.

In the foregoing description, it can be seen that the present invention comprises a new and useful electrical connector 10*a,* 10*b,* 100*a,* 100*b* for use in connection with an electrical package 18 and/or a substrate 20. It should be appreciated that changes could be made to the embodiments described above without departing from the inventive concepts thereof. It should be understood, therefore, that this invention is not limited to the particular embodiments disclosed, but it is intended to cover modifications within the spirit and scope of the present invention as defined by the appended claims.

What is claimed is:

1. An electrical connector comprising a non-conductive generally planar base defining a generally centrally located center aperture extending therethrough, the base having at least three generally identical sectors, the sectors being circumferentially arranged around the center aperture, each sector defining a plurality of contact-receiving apertures extending through the base, each contact-receiving aperture for receiving a contact, the base having a plurality of corners and a pair of opposing generally planar sides, each sector meeting an immediately adjacent sector at one of the corners, each corner having a first general side-to-side thickness, each sector having a second general side-to-side thickness greater than the first thickness, wherein the corners provide the base with a degree of flexibility to relieve physical and thermal stresses thereto.

2. The connector of claim 1 wherein each contact-receiving aperture extends through the base in a first direction generally perpendicular to the base, the contact-receiving apertures in each sector being organized into a plurality of rows, each row in each sector extending along the base in a second direction with regard to such center aperture, and wherein each contact-receiving aperture in each sector also extends along the base in a third direction with regard to such center aperture, the third direction being generally parallel to the base.

3. The connector of claim 2 wherein the second direction and the third direction are generally identical.

4. The connector of claim 2 wherein each contact-receiving aperture in each sector extends along the base generally tangentially with regard to the center aperture.

5. The connector of claim 2 wherein each row in each sector extends along the base generally tangentially with regard to the center aperture.

6. The connector of claim 1 wherein each sector extends generally tangentially with regard to the center aperture.

7. The connector of claim 1 wherein the base is a generally unitary body injection-molded from a non-conductive molding material, the molding material being introduced through the center aperture during such injection-molding.

8. The connector of claim 1 comprising the plurality of contacts.

9. The connector of claim 1 wherein the base comprises four generally identical sectors.

* * * * *